US009050771B2

(12) United States Patent
Gelli et al.

(10) Patent No.: US 9,050,771 B2
(45) Date of Patent: Jun. 9, 2015

(54) CORE WINDER WITH A CUTTING TOOL ASSOCIATED WITH A PRESSURE MEMBER

(75) Inventors: Mauro Gelli, Lucca (IT); Valter Di Nardo, Lucca (IT); Giancarlo Cicalini, Lucca (IT)

(73) Assignee: FABIO PERINI S.P.A., Lucca (IT)

( * ) Notice: Subject to any disclaimer, the term of this patent is extended or adjusted under 35 U.S.C. 154(b) by 782 days.

(21) Appl. No.: 12/733,843

(22) PCT Filed: Sep. 24, 2008

(86) PCT No.: PCT/IT2008/000610
§ 371 (c)(1),
(2), (4) Date: Mar. 24, 2010

(87) PCT Pub. No.: WO2009/040866
PCT Pub. Date: Apr. 2, 2009

(65) Prior Publication Data

US 2010/0197475 A1 Aug. 5, 2010

(30) Foreign Application Priority Data

Sep. 28, 2007 (IT) ..... FI2007A0218
Jan. 17, 2008 (IT) ..... FI2008A0006

(51) Int. Cl.
*B31C 3/00* (2006.01)
*B31C 11/00* (2006.01)
*B26D 3/16* (2006.01)

(52) U.S. Cl.
CPC .. *B31C 3/00* (2013.01); *B31C 11/00* (2013.01)

(58) Field of Classification Search
CPC ..... B31C 3/00; B31C 11/00; B26D 3/16; B26D 3/164
USPC ..... 493/269, 288, 287, 290
See application file for complete search history.

(56) References Cited

U.S. PATENT DOCUMENTS

| | | | | |
|---|---|---|---|---|
| 679,011 | A * | 7/1901 | Allen | 493/278 |
| 3,150,575 | A | 9/1964 | Couzens et al. | |
| 3,220,320 | A | 11/1965 | Brigham | |
| 3,636,827 | A | 1/1972 | Lindberg | |
| 3,756,128 | A * | 9/1973 | Armstrong et al. | 493/290 |
| 3,942,418 | A | 3/1976 | Smith | |
| 5,468,207 | A | 11/1995 | Bower et al. | |
| 5,873,806 | A | 2/1999 | Biagiotti | |

FOREIGN PATENT DOCUMENTS

| | | |
|---|---|---|
| JP | 51-103782 | 8/1976 |
| JP | 61-137496 | 8/1986 |
| WO | WO 95/10400 A1 | 4/1995 |
| WO | WO 2004/101265 A1 | 11/2004 |
| WO | WO 2004/106017 A1 | 12/2004 |

* cited by examiner

*Primary Examiner* — Thanh Truong
*Assistant Examiner* — Praachi M Pathak
(74) *Attorney, Agent, or Firm* — Breiner & Breiner, L.L.C.

(57) ABSTRACT

The machine includes a spindle; a winding unit, cooperating with the spindle to wind one or more strips of web material about the spindle and form a tubular element; and a cutting unit with at least one discoidal cutting tool to divide the tubular element into tubes of a length which can be predetermined. At least one pressure element is associated with the cutting tool to compress the tubular element between the spindle and the pressure element adjacent to the cut performed by the cutting tool.

26 Claims, 11 Drawing Sheets

IV
III 65
54
58
81
79
51
51
39
62
51
51
53
51A
40
41
40
IV
III

Fig.5
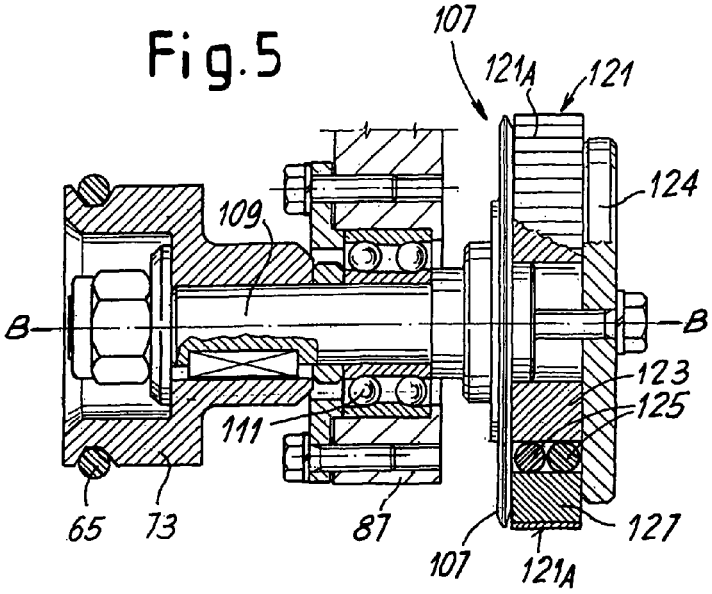
Fig.5A
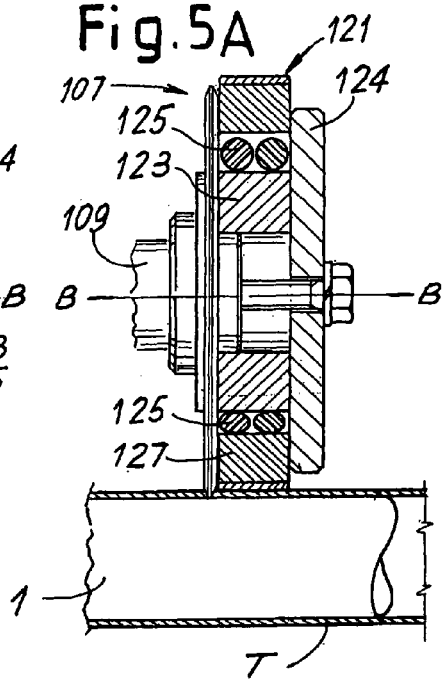
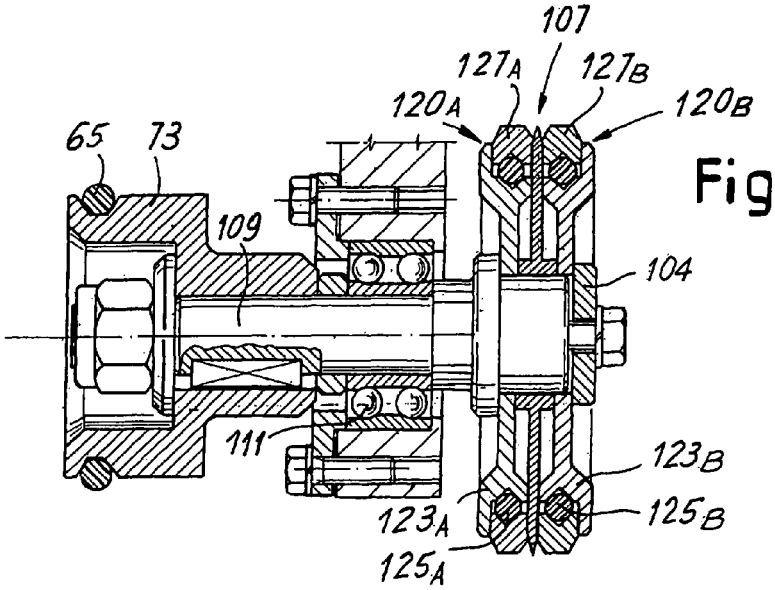
Fig.6

CORE WINDER WITH A CUTTING TOOL ASSOCIATED WITH A PRESSURE MEMBER

TECHNICAL FIELD

The present invention relates to machines for the production of tubes by winding strips of web material, in particular but not exclusively strips of cardboard. More in particular, the present invention relates to machines for the continuous production of tubular elements by winding one or more strips of web material about a forming spindle, comprising a cutting unit which divides the tubular element formed continuously about the forming spindle into single tubes of given length.

STATE OF THE ART

In the production of rolls of web material, such as rolls of toilet paper, rolls of kitchen towel, rolls of nonwoven fabric, rolls of adhesive tape, of plastic film, of metalized film or the like, tubes made of cardboard or other material are generally used as winding cores, obtained by helically winding one or more strips of web material glued to each other. In some cases, winding is longitudinal, instead of helical, i.e. the strip or strips are fed parallel to the axis of the winding spindle and are wrapped about said spindle.

Winding is performed by machines commonly called core winders, which have a forming spindle (fixed or supported idle about its axis) about which the strip or strips of web material, previously provided with a layer of glue, are wound. Usually, winding is obtained through a winding member, typically an endless belt, which forms a helical loop about the spindle and causes the strips of web material to be drawn and wound. The winding member provides the thrust to the helically wound strips, to form the tubular article and to feed it along the winding spindle. In other embodiments the winding unit or member comprises wheels arranged about the axis of the spindle, to perform winding of the strip or strips and feed of the tubular element formed by said strip or strips wound about the spindle.

Examples of machines of this type are described in U.S. Pat. Nos. 3,150,575; 3,220,320; 3,636,827; 3,942,418; 5,468,207; 5,873,806.

The strips of web material are wound in a continuous manner and form a continuous tube, which is subsequently cut into sections of the required length by a cutting member arranged along the tube being formed.

One of the problems encountered in the production and in the subsequent use of these tubes consists in the fact that gluing between the helical strips of web material is not always of sufficient quality to maintain the integrity of the tube. The tubular article, in fact, can be damaged, in particular around the area in which the continuous tubular article is cut into sections due to insufficient adhesion of the glue.

WO-A-2004/101265 describes a core winder in which pressure members are provided, which act on the strips downstream of the forming unit or member, to increase mutual adhesion between the strips and therefore improve the mechanical strength of the tube obtained.

SUMMARY OF THE INVENTION

In order to partially or entirely alleviate or solve the aforesaid problems, according to one aspect the invention provides a machine for the production of tubes through winding one or more strips of web material comprising a spindle, a winding unit, a cutting unit with at least one discoidal cutting tool; wherein at least one pressure element is associated with the cutting tool, to compress the tubular element between the spindle and the pressure element adjacent to the cut performed by the cutting tool. In some embodiments, at least one pressure element is arranged on a side of the cutting tool, such that the cutting tool and the pressure element engage the surface of the tubular element being wound around the spindle at approximately the same position. The pressure element presses or squeezes the material of the tubular element in the cutting area at the time of cutting.

The discoidal cutting tool has a first side or face and a second side or face. In some embodiments the pressure element is arranged adjacent one of said first and second faces or sides, i.e. face-to-face with the cutting tool. In some embodiments a pressure element is arranged face-to-face on each side of the cutting tool.

The pressure element squeezes and consolidates the web material wound about the spindle in the area adjacent to the cutting plane, on at least one side of the cutting plane. When only one pressure element is provided, it is preferably positioned downstream of the cutting tool with respect to the direction of feed of the tube being formed. In other embodiments, two pressure elements can be provided, on both sides of the cutting tool, so as to consolidate or reinforce both ends of the tube cut by the tool.

According to some embodiments, the pressure element has a circular extension and is substantially coaxial with and adjacent to said cutting tool. In some embodiments the pressure element and the cutting tool have parallel rotation axes.

As the cutting tool becomes worn and consequently its diameter decreases, in some particularly preferred embodiments the reciprocal position between pressure element and cutting tool is adjustable. In some embodiments of the invention, adjustment is obtained by adjusting the reciprocal position between the rotation axis of the cutting tool and the rotation axis of the pressure element, in such a way as to regulate the reciprocal position of the two axes so as to arrange the edge of the pressure element and the cutting edge of the cutting tool always in the correct position with respect to the forming spindle and to the tube being formed thereabout. In particular, when the tool becomes worn and its diameter decreases, the axis of the tool is moved toward the axis of the spindle, while the axis of the discoidal pressure element remains in its original position. In this case the rotation axes are parallel but not coincident, i.e. the pressure element and the cutting tool are not exactly co-axial. The distance between the two axes is adjusted according to the degree of wear of the cutting tool and/or according to the diameter thereof.

Preferably, the cutting tool and the pressure element are torsionally constrained to rotate with each other. In some embodiments, rotation can be obtained through drawing by the tube being formed, as a result of friction between the tube and the cutting tool and/or the pressure element. Preferably, according to other embodiments, rotation is obtained through a system for transmitting motion to the cutting tool and/or to the pressure element. The rotational motion can be obtained through a specific actuator provided for this purpose, or can be obtained through an adequate transmission from the motion of the carriage or other member supporting the cutting tool and which moves to follow the forward movement of the tube being formed.

In some embodiments the pressure element comprises a wheel substantially coaxial with and adjacent to the cutting tool or with a rotation axis parallel to the rotation axis of the cutting tool.

The pressure element can include for example a wheel with a substantially cylindrical outer surface, which comes into contact with the tubular element being formed about the spindle, and with an elastic member, which allows displacement of the cylindrical surface with respect to the axis of rotation.

For example, the wheel can comprise a ring made of metal or other substantially rigid material, and a core made of elastic material, for example a rubber or a plastic. In an improved embodiment, the wheel comprises at least a metallic ring and a central core, both made of substantially rigid material, such as steel or other metallic material, and an elastic ring interposed between the central core and the substantially rigid ring.

Further advantageous features and embodiments of the invention will be described hereunder with reference to the accompanying drawings, and in the appended claims.

BRIEF DESCRIPTION OF THE DRAWINGS

The invention will be better understood by means of the description below and the accompanying drawing, which shows a non-limiting practical embodiment of the invention. More in particular, in the drawing:

FIG. 5 shows an enlargement of a longitudinal view of the knife or discoidal cutting tool in one embodiment;

FIG. 5A shows a section analogous to that of FIG. 5, in which operation of the cutting and pressure device is shown;

FIG. 6 shows a longitudinal section of a discoidal cutting tool in a second embodiment;

DETAILED DESCRIPTION OF EMBODIMENTS OF THE INVENTION

Embodiment of FIGS. 1-6

Figure 1:
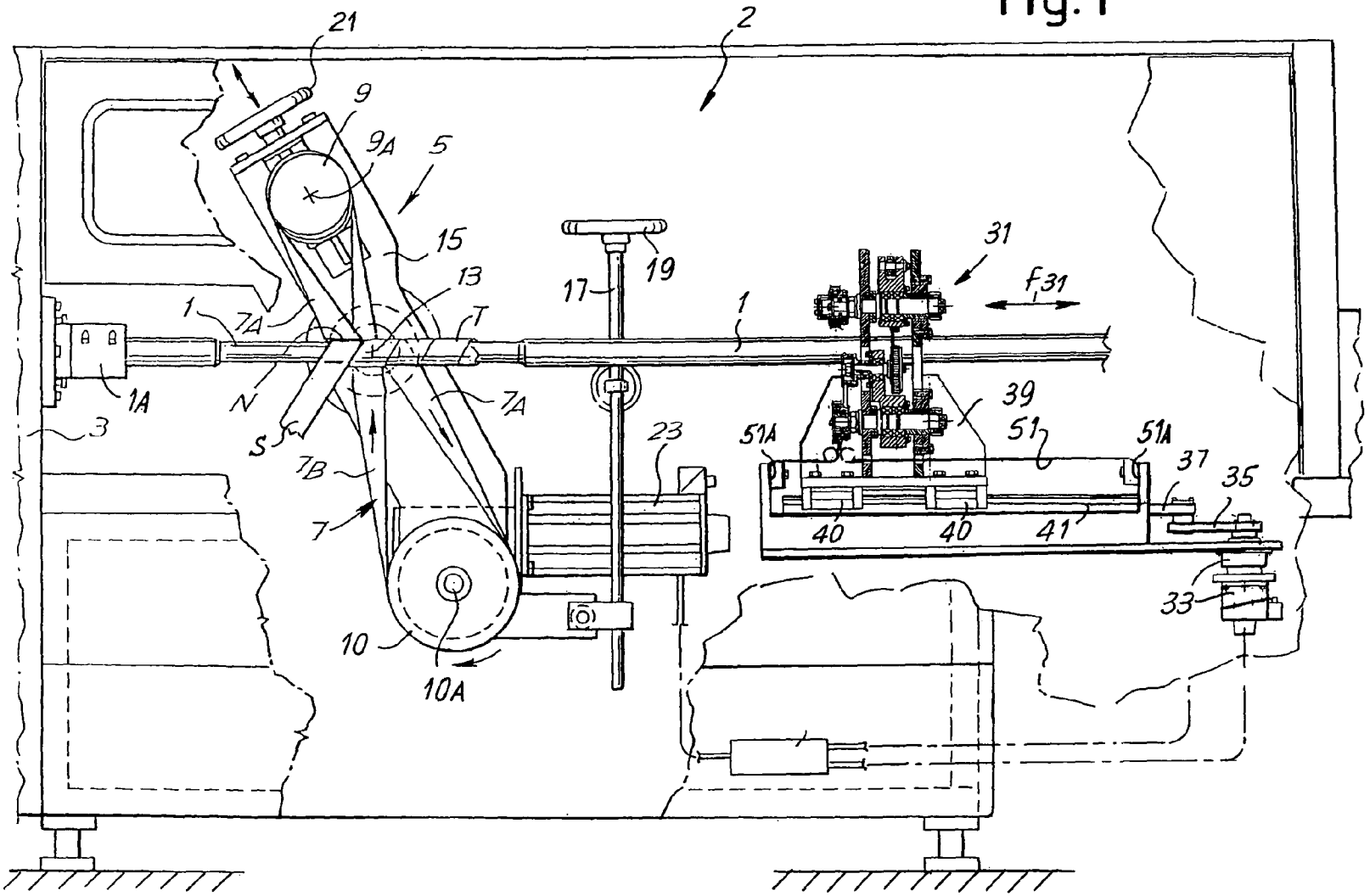
FIG. 1 shows a schematic side view of a core winder according to the invention.
Figure 2:
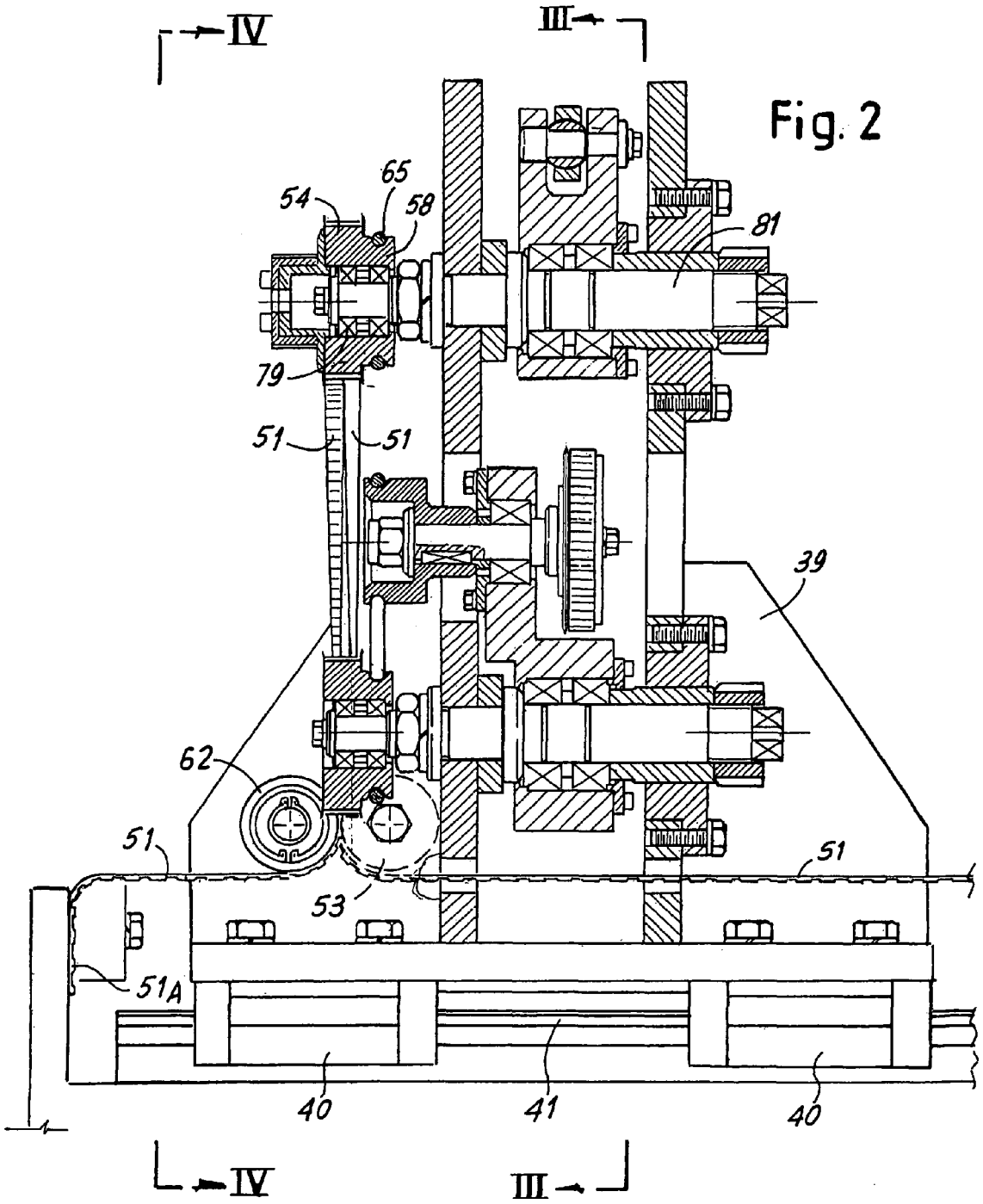
FIG. 2 shows a side view and partial section, according to the line II-II of FIG. 3, of the cutting unit.
Figure 3:
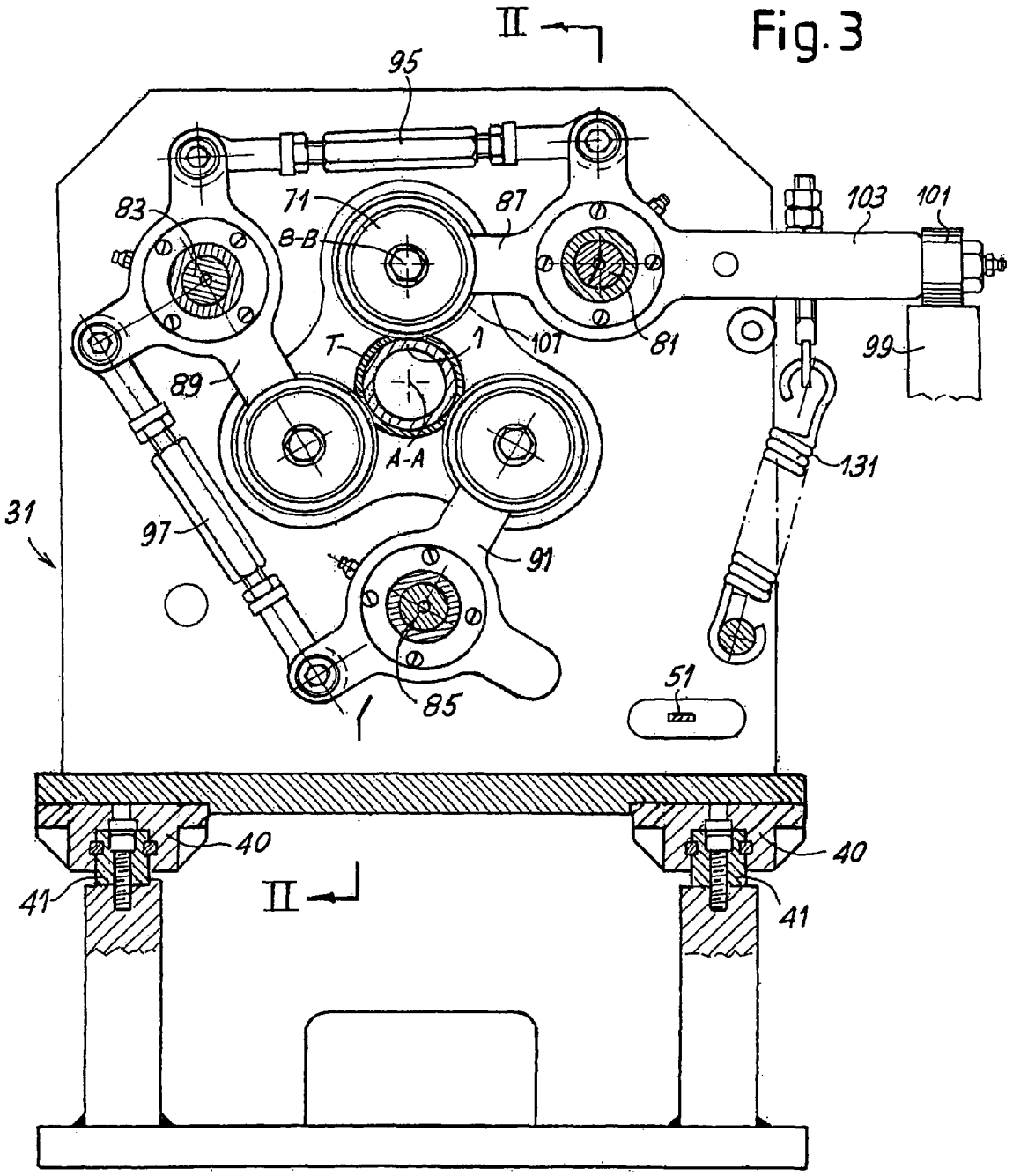
FIGS. 3 and 4 show views according to and IV-IV of FIG. 2.
Figure 4:
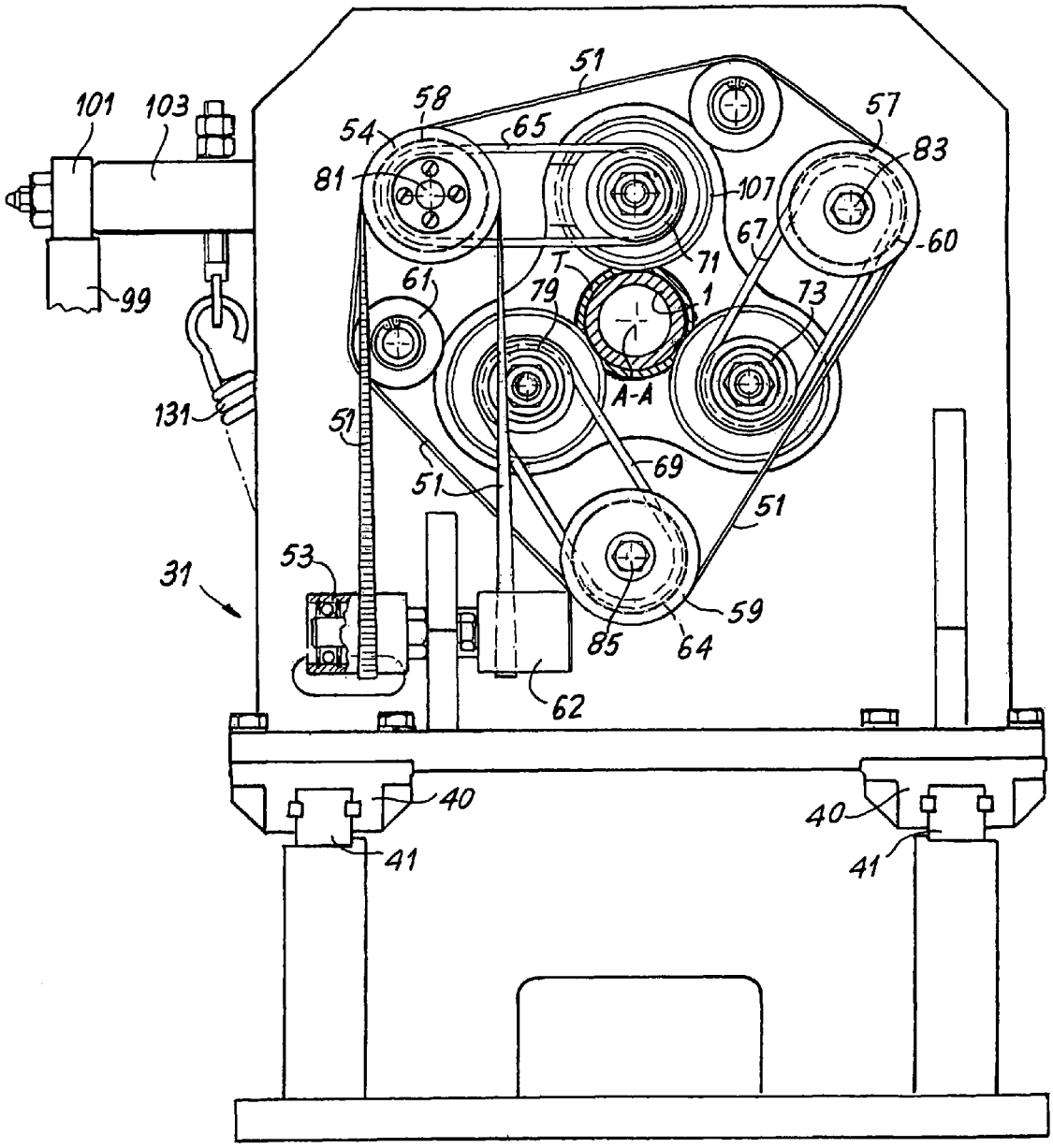

FIG. 1 schematically and briefly shows a core winder for the production of tubes by continuous helical winding of one or more strips S of web material N. One or more of these strips are fed about a winding spindle or forming spindle, to be helically wound about said spindle, with an adequate angle of inclination. Reference number 5 indicates as a whole a winding unit that, in the example illustrated, comprises a belt 7 entrained about pulleys 9 and 10, the rotation axes of which are indicated with 9A and 10A. A portion of the belt extends directly from the pulley 9 to the pulley 10, passing behind the spindle 1 (in the drawing), whilst the other portion indicated with 7A forms a loop 13 about the winding spindle 1 and the strip or strips of web material N which are wound about the spindle 1 to form a tubular element T. Reference number 15 indicates the unit supporting the pulleys 9 and 10. The unit 15 can be adjusted so as to assume an inclination, which can be adjusted through a threaded bar 17 and a regulating handwheel 19. A further regulating handwheel 21 is used for adjusting the tension of the belt 7. The number 23 indicates a motor, which controls rotation of the pulley 10, which is in this case a drive pulley.

The spindle 1 can be mounted idle by means of a support 1A to the fixed structure 3 of the machine, but it is also possible for the spindle N to be mounted rigidly, i.e. not rotatable about its axis, on the structure 3.

The winding unit 5 is shown and described only by way of example, as the invention as described hereunder in greater detail can also be incorporated in machines or core winders with winding units of different form with respect to the form represented in the figure and described above.

The number 31 indicates as a whole a cutting unit provided with a movement according to f31 parallel to the axis of the spindle 1. The movement according to f31 is controlled by a motor 33, which, through a crank 35 and a connecting rod 37 transmits motion to a carriage or slide 39 slidable through sliding blocks 40 on guides 41 substantially parallel to the spindle 1. The cutting unit 31 will be described in greater detail with reference to FIGS. 2 to 5.

The machine described hereinbefore operates in a known manner. Briefly, the winding unit 5 causes helical winding about the spindle 1 and feed of the strips of web material N parallel to said spindle to continuously form the tubular element T. This latter is cut into single tubes or sections through the cutting unit 31, which for this purpose is provided with an alternating movement according to the arrow f31.

Two ends of a belt 51 or other open flexible member, the ends of which are indicated with 51A, are anchored to the fixed structure 3 of the machine. This belt is entrained about a series of pulleys carried by the carriage 39, in such a way that the alternating movement according to f31 controlled by the motor 33 and by the crank-connecting rod mechanism 35, 37 is transformed into alternating rotational motion of at least one cutting tool and of one or more members for supporting the tube and the spindle during the cut performed by the cutting unit 31.

More in particular, the belt 51 is entrained about a first roller 53 with an axis substantially at 90° with respect to the direction of movement f31 of the carriage 39.

The belt 51 is subsequently entrained about a pulley 54, and from this about a tensioning device 55, a pulley 57, a pulley 59, a tensioning device 61, again about the pulley 54 and from this about a roller 62 with an axis parallel to the axis of the roller 51. The pulleys and the tensioning devices 54, 55, 57, 59 and 61 all have axes substantially parallel to the axis of the forming spindle 1 and therefore to the direction f31 of movement of the carriage 39.

A further pulley, indicated respectively with 58, 60 and 64 is integral and coaxial with each pulley 54, 57 and 59. Belts 65, 67 and 69, all taking their movement from the belt 51 and transmitting it to respective guide pulleys 71, 73 and 79, are entrained about the pulleys 58, 60 and 64. The coaxial pulleys 54 and 58 are supported idle by bearings 79 on a pivot pin 81; the pulleys 57 and 60 are supported idle on a pivot pin 83 and the pulleys 59 and 64 are in turn supported idle on a pivot pin 85. As can be seen in particular in FIG. 3, the pulleys 71, 73 and 79 are supported by respective arms 87, 89, and 91, mounted oscillating about the axes of the pivot pins 81, 83 and 85. The oscillating arms are mutually constrained through tension rods 95 and 97, in such a way that their oscillating movement is simultaneous. This movement is controlled by means of a cam 99 (FIG. 3) mounted fixed on the structure 3 of the machine 2, cooperating with which is a feeler roller 101, mounted idle on an appendage 103 forming an extension of the oscillating arm 87.

With this arrangement, the alternating movement according to f31 of the carriage 39 causes movement of the feeler 101 along the cam 99, which has a form such as to cause closing and opening of the arms 87, 89 and 91 whose ends carrying the pulleys 71, 73 and 79 move toward and away from the axis A-A of the spindle 1.

Cutting tools and/or counter wheels are torsionally constrained to the pulleys 71, 73 and 79. In one embodiment, a discoidal cutting tool, which in the example shown takes the form of a circular knife 107 (see in particular also FIG. 5), is torsionally constrained to the pulley 71. For this purpose, the pulley 73 and the knife 107 are supported on a shaft 109 supported idle through bearings 111 on the arm 87. The axis of rotation of the tool 107 and of the pulley 73 is indicated with B-B.

As can be seen in particular in the enlargement of FIG. 5, a pressure element 121 is associated on one side of the cutting tool or discoidal knife 107. In some embodiments the pressure element 121 presents the form of a wheel with a knurled or toothed outer surface 121A, i.e. provided with suitably shaped projections. In some embodiments, the projections of the substantially cylindrical surface 121A of the pressure element 121 can be projections extending linearly parallel to the axis of rotation B-B of the shaft 109. In other embodiments the raised portions can assume truncated-pyramidal forms.

In the embodiment illustrated, the pressure element 121 is substantially composed of an annular core 123 blocked between the discoidal cutting tool 107 and a locking flange 124. Arranged about the central core 123 is a double elastic ring 125, which surrounds the core 123. In some embodiments, each elastic ring 125 presents a circular section. In other embodiments the elastic ring 125 can be monolithic, i.e. it can be constituted by a single annular element instead of a double annular element as shown in FIG. 5. Arranged about the elastic ring 125 is a substantially rigid ring 127, on the outer surface of which the surface 121A knurled or equipped with protuberances as described above is provided. In this manner the elements 123, 125 and 127 form a pressure wheel, the outer diameter of which is slightly larger than or approximately analogous to the diameter of the knife or discoidal cutting tool 107 rotating about the axis B-B. The cutting tool 107 and the various components forming the pressure element 121 are blocked axially on the shaft 109 by a disc 124.

When the cutting tool 107 is taken to operating conditions (FIG. 5A), it is pressed against the surface of the tubular element T, which is gradually formed about the forming spindle 1. The substantially rigid ring 127 is also pressed against the outer surface of the tubular element T and the stress applied to the substantially rigid ring 127 causes localized compression of the elastic ring 125, so that in the contact area with the tubular element T being formed about the spindle 1 the cutting tool 107 projects slightly with respect to the substantially cylindrical surface 121A of the rigid ring 127 of the pressure element 121. In this manner, the cutting edge of the cutting tool 107 can penetrate the thickness of the tubular element T being formed about the spindle 1, while the pressure element 121 presses against the outer surface of the tubular element T. More precisely, the wheel or pressure element 121 presses against the annular portion of the tubular element T which is adjacent to the cutting plane defined by the rotating discoidal tool 107 downstream (with respect to the feed movement of the tubular element T) with respect to the cutting tool 107. In this manner, the pressure exerted by the pressure element 121 on the outer surface of the tubular element T during cutting consolidates the area of the tube obtained by cutting the continuous tubular element adjacent to the cutting plane at one of the two ends of this tube.

This end area of the tube is the most fragile and most subject to damage due to imperfect adhesion of the wound web material, which forms the tubular element T. Therefore, the pressure element 121 stabilizes and consolidates the weakest area of the section of each tube.

The cutting pressure and the pressure exerted by the pressure element 121 against the tube being formed about the forming spindle 1 are obtained as a result of the thrust of the cam 99 against the feeler 101 carried idle by the appendage 103. It would also be possible for the cam 99, instead of being fixed to the structure 3 of the machine 2, to be provided with an oscillating movement to take it alternatively to an operating position and to an inactive position. Whatever the solution adopted, i.e. with a fixed or moving cam 99, any movement of the cam and the form thereof ensure that the assembly formed by the arms 87, 89 and 91 is in the position closest to the spindle 1 when the carriage 39 moves in the direction of feed of the tubular element T being formed, i.e. during the cutting step. Vice versa, in the reverse movement, during which the carriage 39 with the cutting tool carried thereby moves toward the forming unit 5 again, the form of the cam 99 and/or movement thereof away from the feeler 101 ensure that the arms 87, 89 and 91 move away from the axis A-A of the forming spindle 1. A spring 131 carries the arms to the position moved away with respect to the axis A-A of the spindle 1.

In one embodiment, instead of a single cutting tool, two or three cutting tools coaxial with the pulleys 71, 73 and 79 can be provided. Vice versa, in the embodiment shown, while a discoidal cutting tool 107 with the respective pressure element 121 is mounted coaxial with the pulley 71, a simple supporting wheel, on which the pressure stresses exerted by the pressure element 121 and by the cutting tool 107 are released, is mounted coaxial with each of the remaining pulleys 73 and 79.

In a modified embodiment, shown in FIG. 6, two pressure elements indicated with 120A and 120B are integral with the pulley 73, with which the cutting tool 107 is coaxial and torsionally integral. The two pressure elements 120A and 120B are arranged adjacent to the two sides of the discoidal cutting tool or discoidal knife 107. Each pressure element 120A, 120B has a central core designated 123A and 123B respectively. Arranged about the central cores 123A, 123B are elastic rings 125A, 125B, arranged about which in turn are substantially rigid, rings 127A, 127B substantially similar in form and function to the substantially rigid ring 127 of FIG. 5. The pressure elements 120A, 120B and the discoidal cutting tool or knife 107 are blocked by a flange or disc 124 similar to that illustrated in FIG. 5.

With the arrangement of FIG. 6 an effect of compression and stabilization, of the material forming the tube is obtained both upstream and downstream of the cutting plane defined by the discoidal cutting tool 107, in such as way that ultimately each tube obtained by cutting the continuous tubular element T has both ends consolidated due to the pressure exerted by the two pressure elements 120A, 120B.

Embodiment of FIGS. 7 to 13

Figure 7:
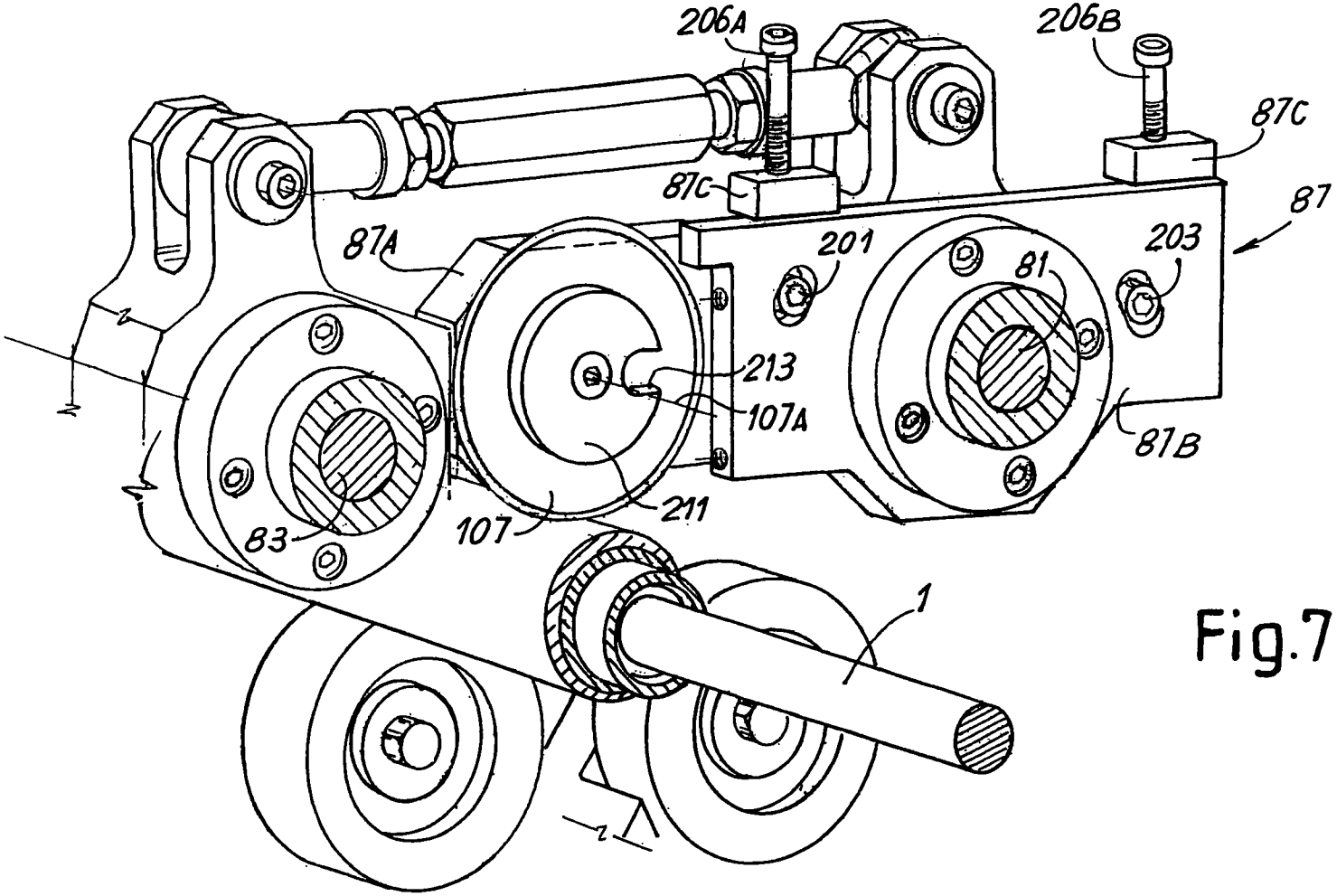
FIG. 7 shows an axonometric view of the cutting unit, from which the pressure element has been removed, to show the cutting tool in greater detail, according to a further embodiment of the invention.
Figure 8:
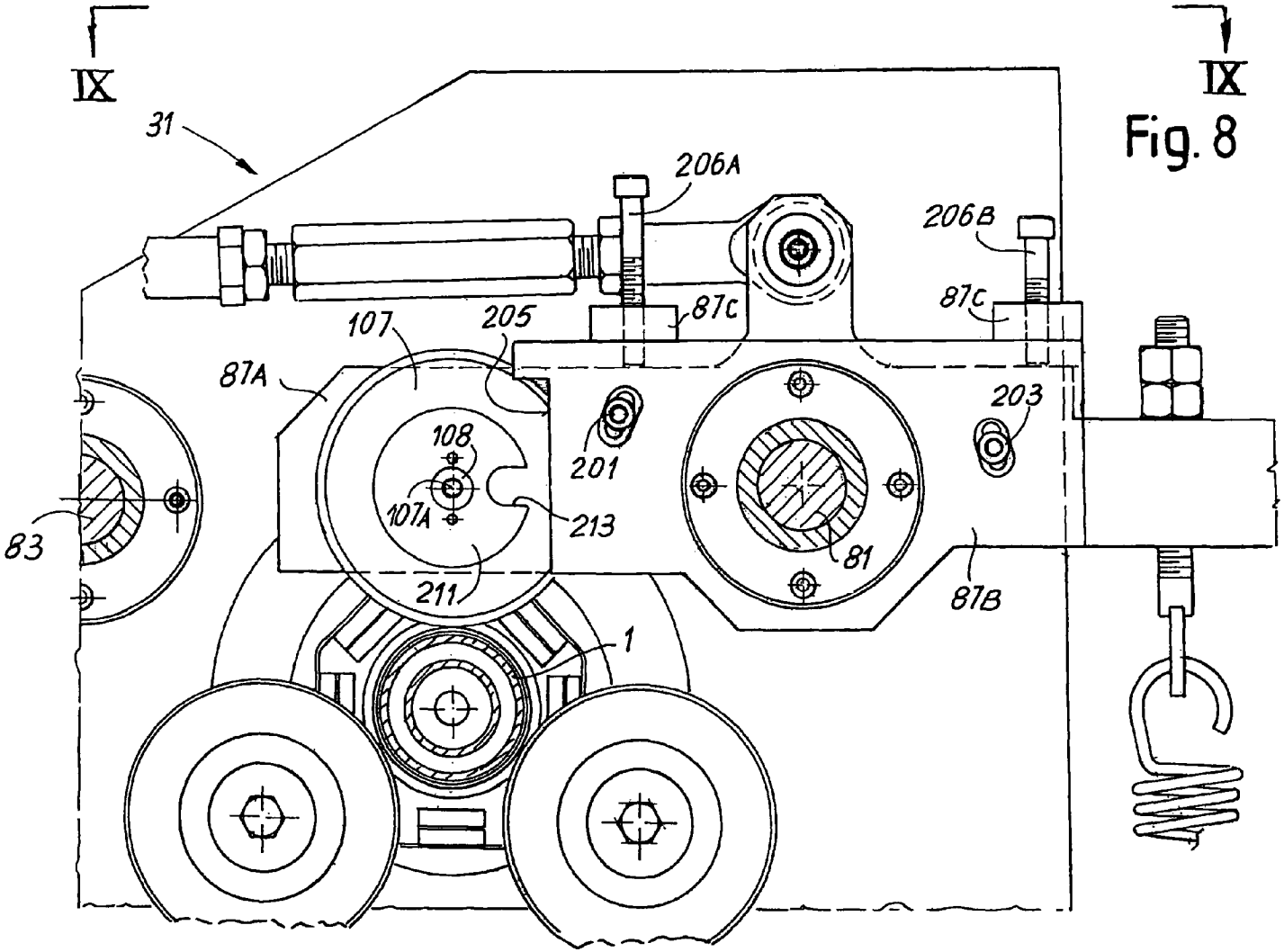
FIG. 8 shows a front view of the cutting unit of FIG. 7, according to the line VIII-VIII of FIG. 9.
Figure 9:
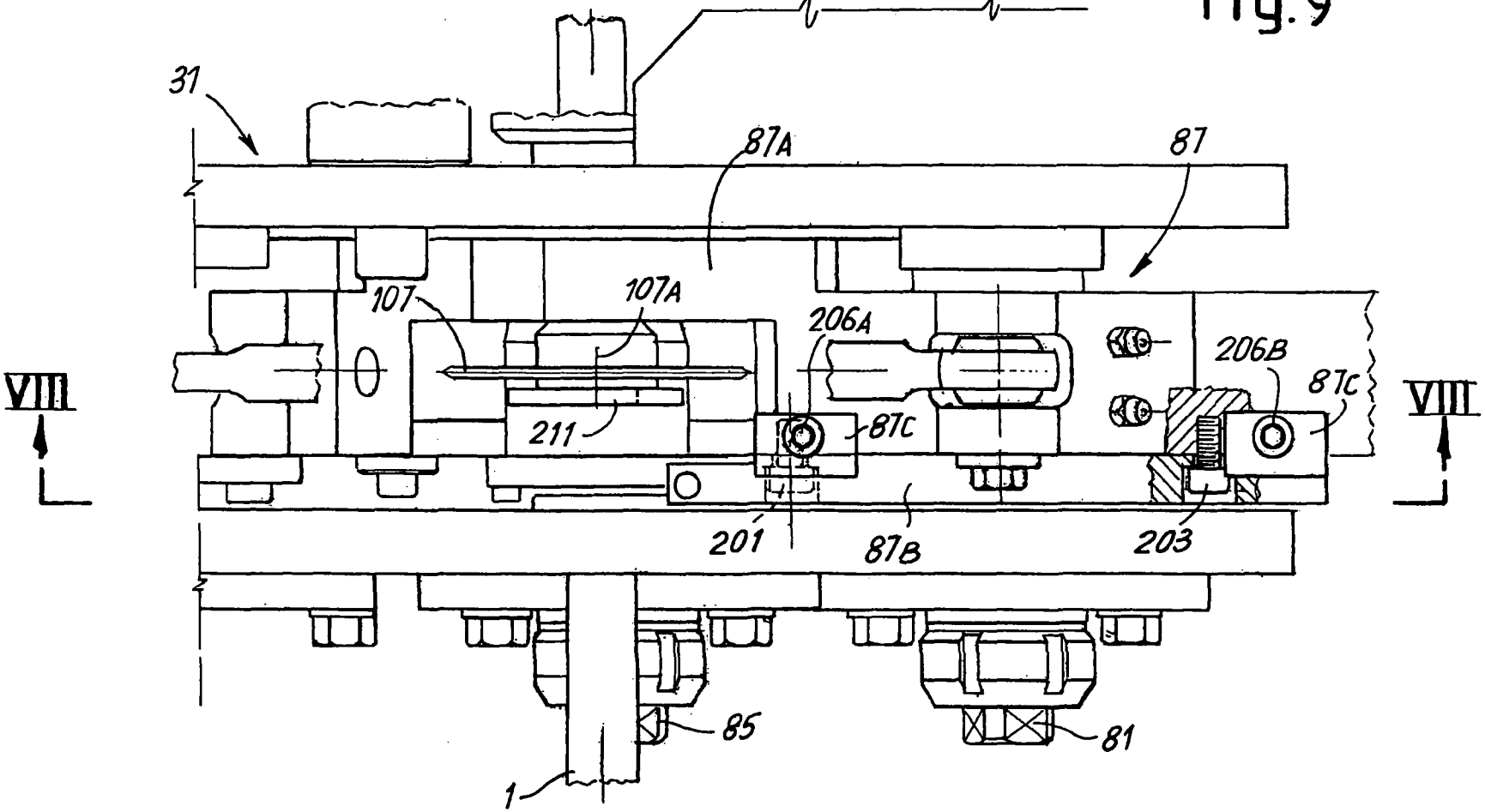
FIG. 9 shows a plan view according to IX-IX of FIG. 8.
Figure 10:
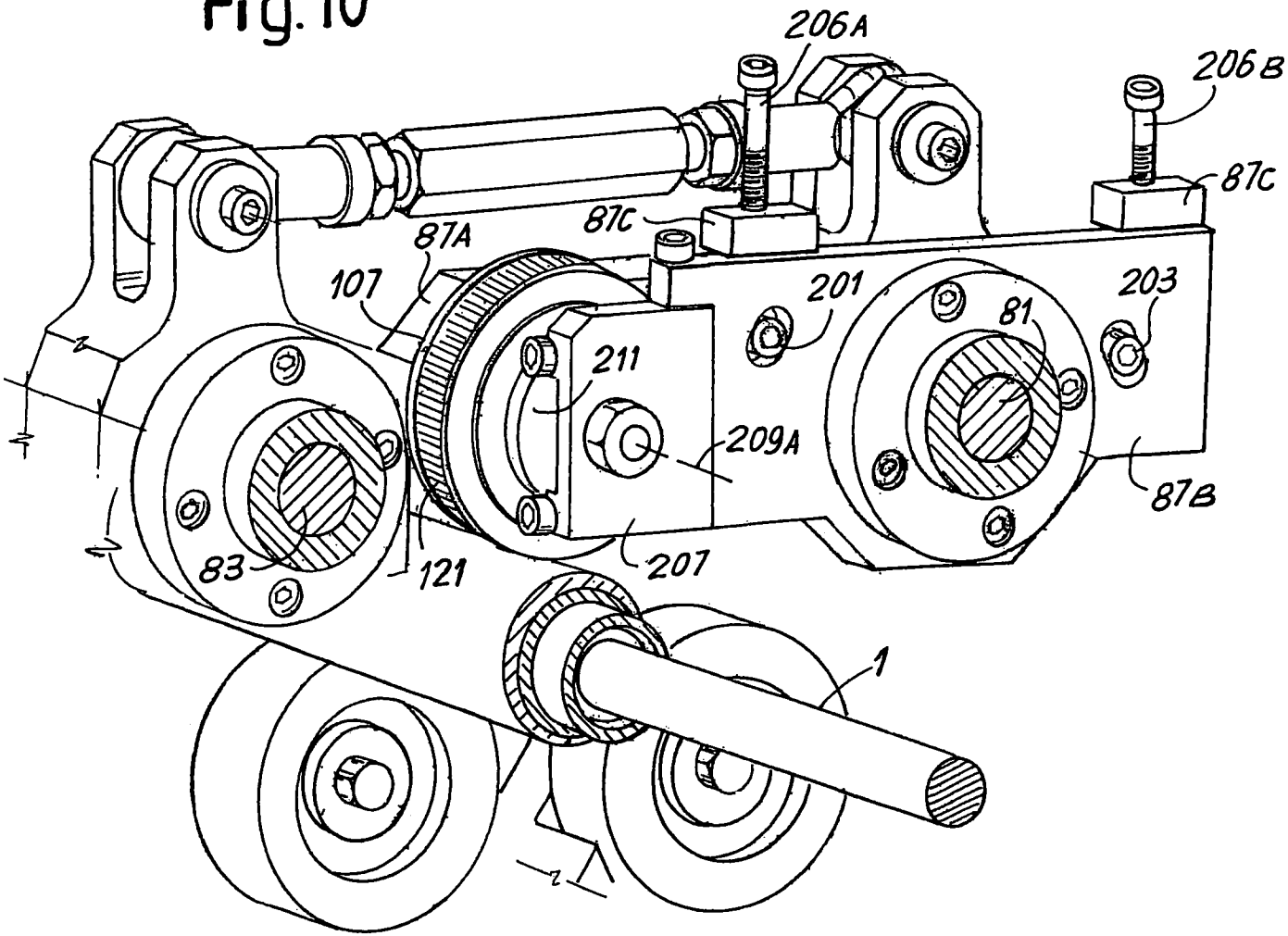
FIG. 10 shows an axonometric view analogous to the view of FIG. 7, with the pressure element mounted.
Figure 11:
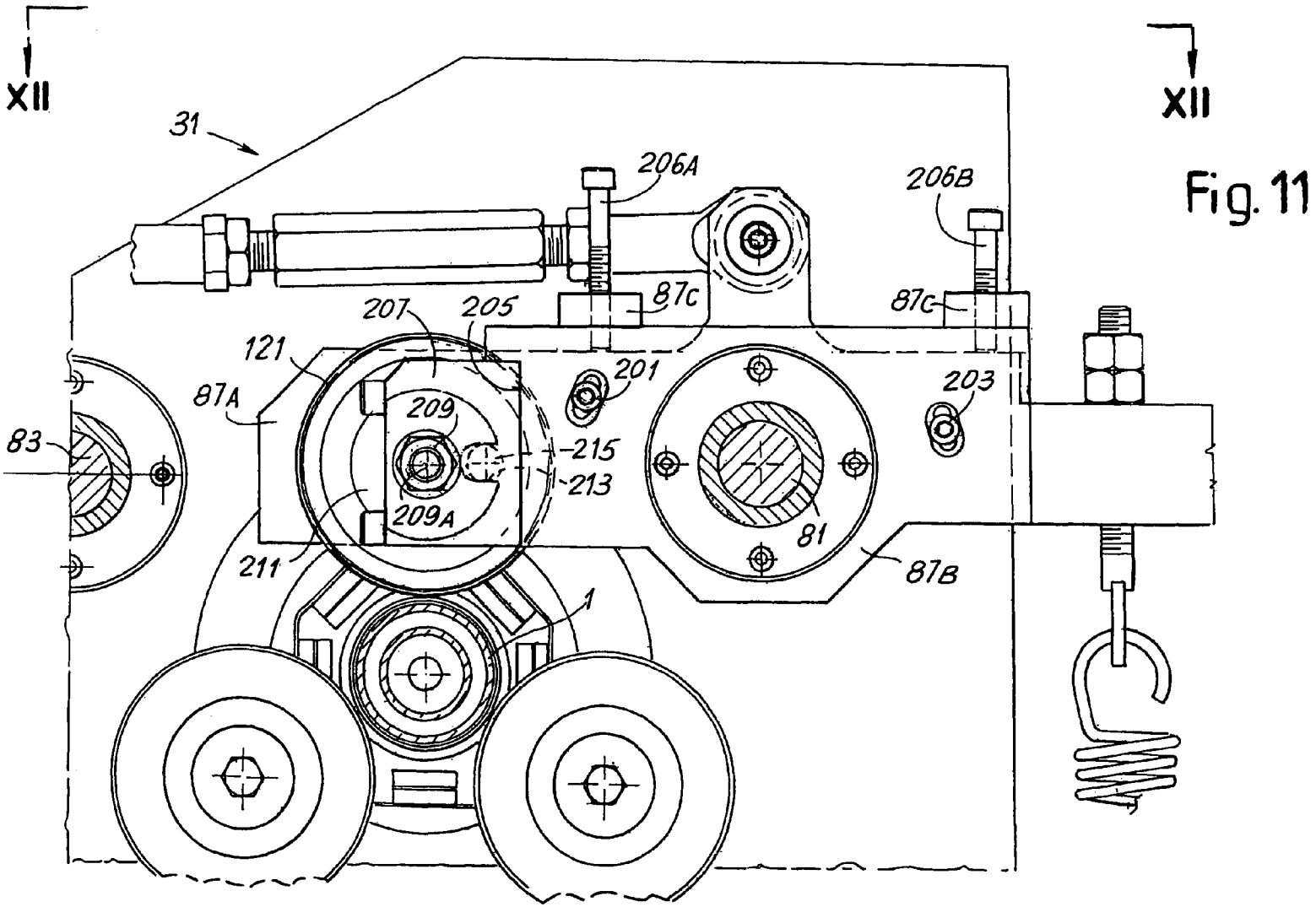
FIG. 11 shows a front view according to XI-XI of FIG. 12 of the unit of FIG. 10.
Figure 12:
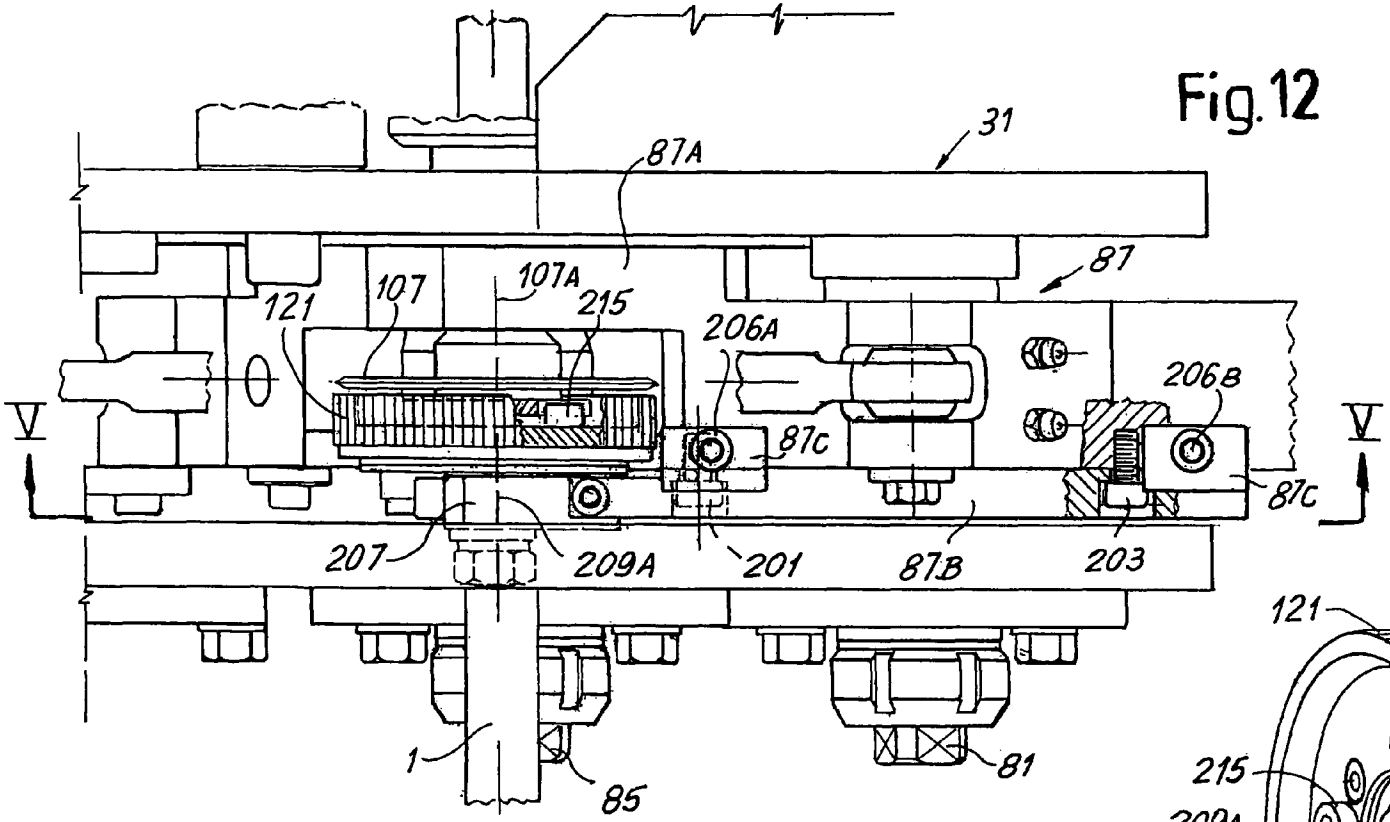
FIG. 12 shows a plan view according to of FIG. 10.
Figure 13:
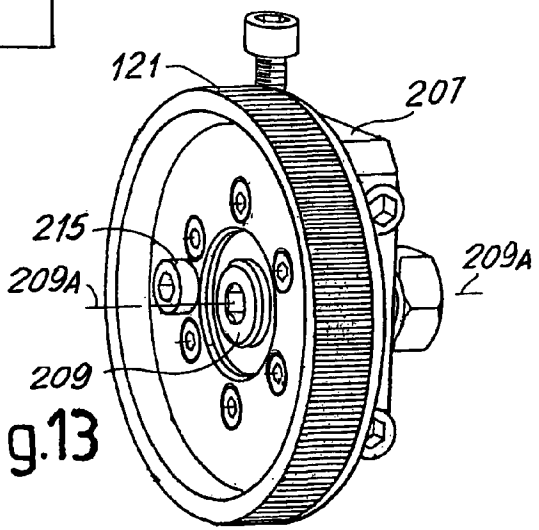
FIG. 13 shows an axonometric view of the pressure element isolated from the cutting unit.

FIGS. 7 and 13 show a modified embodiment of the invention. The features described below can be incorporated in a core winder having any structure, providing it is compatible with the structure of the members illustrated below. In particular, the following embodiment can be incorporated in a machine of the type illustrated and described in greater detail above with reference to FIGS. 1 to 6. Elements and parts of the machine, which can be equal or equivalent to those disclosed with respect to FIGS. 1-6 are not described again.

In the embodiment of FIGS. 7 to 13, a single discoidal cutting tool 107 is associated with the cutting unit 31, carried by an arm 87 oscillating about a pivot pin 81 and on which a substantially circular shaped pressure element, such as a wheel and indicated with 121, is also carried. The oscillating arm 87 is controlled by a kinematic mechanism analogous to the one described in connection with FIGS. 1-6. It is associated with other two oscillating arms 89, 91, pivoted about respective pivot pins 85, 87. As described in the aforesaid prior application, the various oscillating arms 87, 89, 91 are constrained to oscillate simultaneously toward the spindle 1 and to simultaneously move away from it in a manner synchronized with the motion of the cutting unit 31. In the example illustrated the arms 89 and 91 carry supporting wheels or pressure elements analogous to that indicated with 121 and are without cutting tool. However, it would also be possible to design each of the three oscillating arms (or at least two of these) in the same manner as described hereunder for the arm 87, so that each of these, or at least two of these each carry a cutting tool and a pressure element, adjustable with respect to each other to modify, when required, the reciprocal position of the axes of rotation.

With specific reference to the arm 87, it is comprised of two portions or arms 87A, 87B, reciprocally lockable through screws 201, 203 and oscillating about the common axis represented by the axis of the pivot pin 81. The arm 87A carries the cutting tool 107, while the arm 87B carries the wheel or pressure element 121.

When the two arms 87A, 87B are reciprocally blocked they form a single arm that oscillates when controlled by the kinematic mechanism of the cutting unit 31, already described in the previous embodiment (FIGS. 1-6). By releasing one arm with respect to the other, it is instead possible to adjust the reciprocal angular position of the two arms or arm portions 87A, 87B, in such a way as to modify the relative position of the axis of the discoidal cutting tool 107 and of the wheel or pressure element 121, while maintaining these axes approximately parallel to each other. The screws 201, 203 engage in threaded holes of the arm 87A and pass through curved slots produced in the arm 87B, so that by loosening the screws it is possible to move the two arms 87A, 87B by a few degrees with respect to each other and block them reciprocally in the desired angular position. In some embodiments, angular adjustment of the two arms can take place through a pair of adjusting screws 206A, 206B, which engage in respective threaded through holes provided in appendages 87C of the arm 87B and the ends of which press on the arm 87A. In this case adjustment of the reciprocal angular position of the two arms or arm portions 87A, 87B takes place by loosening the locking screws 201 and 203 and acting on the adjusting screws 206A, 206B.

The arm 87B has a seat 205, inside which a block 207 can be mounted and fixed, which idly supports the pressure element 121 through a shaft 209, the axis of which is indicated with 209A. This axis is substantially parallel to the axis 107A of the cutting tool 107, i.e. to the axis of the shaft 108, which supports the cutting tool 107. This constructional solution allows easy access to the cutting tool 107, by removing the block 207.

By adjusting the angular position of the arms or arm portions 87A, 87B it is possible to modify the reciprocal position of the axes 107A and 209A of the cutting tool 107 and of the pressure element 121, so that when the cutting tool is worn and decreases in diameter, or when it must be replaced with a new cutting tool, of greater diameter, it is possible to adjust the reciprocal position of the cutting edge of the cutting tool 107 and of the knurled surface of the pressure element 121 so that the cutting edge of the tool projects slightly toward the axis of the spindle 1 with respect to the outer circumference of the pressure element 121. In this way the position of the cutting tool 107 is always such as to perform the cut through the full thickness of the tube being formed about the forming spindle 1, while the substantially cylindrical knurled surface of the pressure element 121 presses against the outer surface of the tube downstream of the cut, with respect to the direction of feed of the tube being formed along the spindle 1. This pressure compresses or presses the tube consolidating the fibers and increasing its strength along the transverse cutting plane.

In some embodiments, the cutting tool 107 is carried in rotation through a suitable transmission system. The pressure element 121 could be carried in rotation through simple friction with the tube being formed about the spindle 1. However, according to some preferred embodiments of the invention, the pressure element 121 is connected mechanically to the discoidal cutting tool 107 so as to receive rotational motion therefrom and rotate at the same speed as this tool.

In some embodiments, this coupling is obtained by providing a flange 211 coaxial with the cutting tool 107 and torsionally constrained thereto, which has a groove 213 extending substantially radially. A pivot pin 215, integral with the pressure element or wheel 121 and positioned eccentric with respect to the axis of rotation 209A of said pressure element, engages in said groove. In this way a torsional coupling is obtained between the components 107 and 121 and the pressure element 121 rotates in a manner synchronized with the cutting tool 107. The structure of the kinematic coupling is such as to allow offset between the pressure element 121 and the cutting tool 107 and thus allows angular adjustment of the two arms 87A, 87B.

In the example shown three oscillating arms 87, 89, 91 are provided, the first carrying a knife or discoidal cutting tool and a pressure element, while the others only carry supporting elements in the form of pressure wheels. Nonetheless, it would also be possible to position respective discoidal cutting tools on the other oscillating arms with an arrangement similar to that described with reference to the elements associated with the arm 87.

Moreover, the criterion of providing the pressure element adjustable with respect to the cutting tool can also be implemented in machines of different structure, for example with only one oscillating arm or two oscillating arms to support a single tool with associated pressure element, two tools with associated pressure elements or one tool and a pressure element on one arm and a single pressure or supporting wheel on the other.

In other embodiments, not illustrated, the cutting tool can be idle and carried in rotation only as a result of contact with the tube being formed about the spindle, and analogously, instead of the pressure element being drawn in rotation by the cutting tool, it can be mounted idle and drawn by the force of friction created by contact with the tube being formed.

In some embodiments two pressure elements can be positioned one on each side of the cutting tool to compress the tube being formed at both ends. In this case the oscillating supporting arm 87 can, for example, be designed with two angularly adjustable portions or arms, in which the one that carries the pressure elements has a fork structure and carries in an intermediate position the portion of arm that supports the knife.

In the above embodiments the invention is applied in a core winder is of a kind in which the tubular element is formed by helical winding one or more strips of cardboard or other material. However, similar advantages can be obtained also in core winders or tube-forming machines wherein the tubes are generated by longitudinal winding, i.e. by winding one or more strips of cardboard or other suitable material according to a direction parallel or substantially parallel to the axis of the winding mandrel.

It is understood that the drawing only shows an example provided by way of a practical demonstration of the invention, which can vary in forms and arrangements without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A machine for producing tubes by winding one or more strips of web material comprising:

a spindle;

a winding unit cooperating with said spindle to wind said one or more strips of web material about said spindle and form a tubular element;

a cutting unit with at least one discoidal cutting tool, said cutting tool having a first side and a second side, to divide said tubular element into tubes having predetermined lengths;

at least one circular pressure element having a rotation axis parallel to or substantially coaxial with a rotation axis of said at least one cutting tool and arranged adjacent one of said first side and said second side of said at least one cutting tool, to compress the tubular element between said spindle and said at least one pressure element adjacent to a cut by said at least one cutting tool;

wherein said at least one circular pressure element is supported in an adjustable position with respect to a position of the at least one cutting tool so as to be adapted to adjust reciprocal positions between the rotation axis of the cutting tool and the rotation axis of the pressure element to regulate the reciprocal positions of each said rotation axis to compensate for a change in diameter of said cutting tool such that the rotation axis of the cutting tool and the rotation axis of the pressure element following adjustment remain parallel but not coincident.

2. The machine as claimed in claim 1, wherein said at least one pressure element rotates integrally with said at least one cutting tool.

3. The machine as claimed in claim 2, wherein said at least one pressure element acts downstream of the at least one cutting tool in a direction of feed of the tubular element to be cut.

4. The machine as claimed in claim 2, wherein said at least one pressure element comprises two members having a substantially circular shape, adjacent to said first side and said second side of said cutting tool.

5. The machine as claimed in claim 1, wherein said at least one pressure element acts downstream of the at least one cutting tool in a direction of feed of the tubular element to be cut.

6. The machine as claimed in claim 1, wherein said at least one pressure element comprises two members having a substantially circular shape, adjacent to said first side and said second side of said cutting tool.

7. The machine as claimed in claim 1, wherein said at least one pressure element comprises a wheel with a substantially cylindrical outer surface, which comes into contact with the tubular element being formed about the spindle, and with an elastic member that allows displacement of the cylindrical outer surface with respect to the axis of rotation of the at least one pressure element.

8. A machine for producing tubes by winding one or more strips of web material comprising:

a spindle;

a winding unit cooperating with said spindle to wind said one or more strips of web material about said spindle and form a tubular element;

a cutting unit with at least one discoidal cutting tool, said cutting tool having a first side and a second side, to divide said tubular element into tubes having predetermined lengths;

at least one circular pressure element having a rotation axis parallel to or substantially coaxial with a rotation axis of said at least one cutting tool and arranged adjacent one of said first side and said second side of said at least one cutting tool, to compress the tubular element between said spindle and said at least one pressure element adjacent to a cut by said at least one cutting tool;

wherein said at least one circular pressure element comprises a wheel with a substantially cylindrical and substantially rigid outer surface, which comes into contact with the tubular element being formed about the spindle, and with an elastic member situated interiorly of said wheel and adapted to allow displacement of the substantially cylindrical and substantially rigid outer surface with respect to the axis of rotation of the at least one pressure element and wherein said at least one pressure element rotates integrally with said at least one cutting tool.

9. The machine as claimed in claim 8, wherein said at least one pressure element acts downstream of the at least one cutting tool in a direction of feed of the tubular element to be cut.

10. The machine as claimed in claim 8, wherein said at least one pressure element comprises two members, having a substantially circular shape, adjacent to said first side and said second side of said cutting tool.

11. The machine as claimed in claim 1 or 8, wherein said at least one pressure element comprises at least one wheel with a central core, an elastic ring surrounding said central core, and a substantially rigid ring positioned about the elastic ring.

12. The machine as claimed in claim 11, wherein the substantially rigid ring has an outer diameter which is larger than a diameter of said cutting tool, the elastic ring being deformable by compression and allows the cutting tool to project radially with respect to the substantially rigid ring.

13. The machine as claimed in claim 1 or 8, wherein said at least one pressure element comprises, on each side of the at least one cutting tool, a wheel with a central core, an elastic ring surrounding said central core, and a substantially rigid ring positioned about the elastic ring.

14. The machine as claimed in claim 13, wherein the substantially rigid ring has an outer diameter which is larger than a diameter of said cutting tool, the elastic ring being deformable by compression and allows the cutting tool to project radially with respect to the substantially rigid ring.

15. The machine as claimed in claim 1 or 8, wherein said at least one pressure element has an approximately cylindrical knurled surface cooperating with said spindle, the tubular element being compressed between the spindle and the knurled surface of said pressure element.

16. The machine as claimed in claim 1 or 8, further comprising one or more supporting wheels positioned about the spindle on which thrust of the cutting tool and the pressure element are released.

17. The machine as claimed in claim 1 or 8, wherein said pressure element is drawn in rotation by said cutting tool.

18. The machine as claimed in claim 1 or 8, wherein said pressure element is carried by a moving arm, to which the cutting tool is also connected.

19. The machine as claimed in claim 18, wherein said moving arm oscillates about a respective oscillation axis and is made in two portions, lockable with respect to each other, in reciprocal positions that are angularly adjustable with respect to each other about said oscillation axis.

20. The machine as claimed in claim 18, wherein said pressure element is supported idle by a supporting block, constrained removably to said moving arm.

21. The machine as claimed in claim 20, wherein said moving arm oscillates about a respective oscillation axis and is made in two portions, lockable with respect to each other, in reciprocal positions that are angularly adjustable with respect to each other about said oscillation axis.

22. The machine as claimed in claim 20, wherein said moving arm oscillates about a respective oscillation axis and is made in two portions, lockable with respect to each other, in reciprocal positions that are angularly adjustable with respect to each other about said oscillation axis, and wherein said supporting block is connected to a first of said two portions and a second of said two portions carries said cutting tool.

23. A method for producing tubes comprising continuously winding at least one strip of web material around a forming mandrel to form a continuous tubular element; sequentially cutting tubes from said continuous tubular element by a cutting tool defining a cutting plane; pressing and consolidating said tubular element during said cutting in an area adjacent to said cutting plane, on at least one side of the cutting plane by at least one rotating pressure element having a substantially circular shape and supported in an adjustable position with respect to a position of said cutting tool so as to be adapted to adjust reciprocal positions between a rotation axis of the cutting tool and a rotation axis of the pressure element to regulate the reciprocal positions of each of said rotation axis to compensate for a change in diameter of said cutting tool such that the rotation axis of the cutting tool and the rotation axis of the pressure element following adjustment remain parallel but not coincident, said rotating pressure element being arranged and acting adjacent the cutting tool on at least one side thereof.

24. A machine for producing tubes by winding one or more strips of web material comprising:

a spindle;

a winding unit cooperating with said spindle to wind said one or more strips of web material about said spindle and form a tubular element;

a cutting unit with at least one discoidal cutting tool, said cutting tool having a first side and a second side, to divide said tubular element into tubes having predetermined lengths;

at least one circular pressure element having a rotation axis parallel to or substantially coaxial with a rotation axis of said at least one cutting tool and arranged adjacent one of said first side and said second side of said at least one cutting tool, to compress the tubular element between said spindle and said at least one pressure element adjacent to a cut by said at least one cutting tool;

wherein said at least one circular pressure element is supported in an adjustable position with respect to a position of the at least one cutting tool;

wherein said pressure element is arranged to rotate about a rotation axis substantially parallel to the rotation axis of the cutting tool, and positions of the rotation axis of the pressure element and the rotation axis of the cutting tool are adjustable; and wherein said pressure element is drawn in rotation by said cutting tool, and said pressure element and said cutting tool are torsionally connected through a coupling that allows a displacement of the rotation axis of said pressure element with respect to the rotation axis of said cutting tool.

25. The machine as claimed in claim 24, wherein said cutting tool and said pressure element are torsionally constrained by the coupling and the coupling is formed by a slot or groove extending approximately radially with respect to said pressure element or said cutting tool, in which a pin that rotates integrally with said cutting tool or with said pressure element engages.

26. The machine as claimed in claim 25, wherein said slot or groove is integral with said cutting tool and said pin is integral with the pressure element, in an eccentric position with respect to the rotation axis of said pressure element.

* * * * *